US009739165B2

(12) United States Patent
Uesugi et al.

(10) Patent No.: US 9,739,165 B2
(45) Date of Patent: Aug. 22, 2017

(54) VARIABLE NOZZLE TURBOCHARGERS

(71) Applicants: KABUSHIKI KAISHA TOYOTA JIDOSHOKKI, Kariya-shi, Aichi-ken (JP); TOYOTA JIDOSHA KABUSHIKI KAISHA, Toyota-shi, Aichi-ken (JP)

(72) Inventors: Tsuyoshi Uesugi, Kariya (JP); Hiroaki Ikegami, Toyota (JP)

(73) Assignees: KABUSHIKI KAISHA TOYOTA JIDOSHOKKI, Kariya-shi, Aichi-ken (JP); TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 522 days.

(21) Appl. No.: 14/276,411

(22) Filed: May 13, 2014

(65) Prior Publication Data

US 2014/0341718 A1 Nov. 20, 2014

(30) Foreign Application Priority Data

May 16, 2013 (JP) ..... 2013-104078

(51) Int. Cl.
*F04D 29/56* (2006.01)
*F01D 17/16* (2006.01)

(52) U.S. Cl.
CPC ..... *F01D 17/165* (2013.01); *F05D 2220/40* (2013.01)

(58) Field of Classification Search
CPC ..... F01D 17/165; F05D 2220/40
See application file for complete search history.

(56) References Cited

U.S. PATENT DOCUMENTS 4,403,912 A * 9/1983 Pekari ..... F01D 17/162 415/150
4,654,941 A * 4/1987 Burdette ..... F01D 17/165 29/889.22
4,659,295 A * 4/1987 Burdette ..... F01D 17/165 415/164
4,695,220 A * 9/1987 Dawson ..... F04D 29/563 415/156

(Continued)

FOREIGN PATENT DOCUMENTS

JP 63-92036 U 6/1988
JP 63-115532 U 7/1988

(Continued)

OTHER PUBLICATIONS

Communication dated Apr. 21, 2015 from the Japanese Patent Office in counterpart application No. 2013-104078.

*Primary Examiner* — Jesse Bogue
(74) *Attorney, Agent, or Firm* — Sughrue Mion, PLLC

(57) ABSTRACT

Embodiments of the present invention may include a variable nozzle turbocharger having a variable nozzle mechanism for controlling a flow velocity of exhaust gas to a turbine wheel. The variable nozzle mechanism includes a plurality of variable nozzles, a unison ring and a biasing member. The variable nozzles each have a nozzle vane. The unison ring is configured to adjust a degree of opening of the variable nozzles through rotation of the unison ring. The biasing member biases the unison ring so as to open the variable nozzles.

8 Claims, 6 Drawing Sheets

(56) References Cited

U.S. PATENT DOCUMENTS

| | | | | |
|---|---|---|---|---|
| 6,779,971 | B2 * | 8/2004 | Garrett | F01D 17/165 415/156 |
| 6,951,450 | B1 * | 10/2005 | Figura | F01D 9/026 415/164 |
| 7,490,470 | B2 * | 2/2009 | Jinnai | F01D 17/165 29/889.2 |
| 9,103,229 | B2 * | 8/2015 | Eriksson | F01D 17/165 |
| 2008/0216780 | A1 * | 9/2008 | Nakamura | F01L 1/3442 123/90.15 |
| 2008/0276613 | A1 * | 11/2008 | Noelle | F01D 17/165 60/595 |
| 2010/0150701 | A1 * | 6/2010 | Simon | F01D 5/146 415/160 |
| 2010/0260597 | A1 | 10/2010 | Sausse et al. | |
| 2012/0121392 | A1 * | 5/2012 | Azuma | F02B 37/24 415/151 |
| 2012/0328416 | A1 * | 12/2012 | Igarashi | F01D 17/105 415/159 |
| 2015/0167481 | A1 * | 6/2015 | Hung | F01D 9/04 415/208.2 |
| 2015/0192133 | A1 * | 7/2015 | An | F02B 37/225 415/203 |

FOREIGN PATENT DOCUMENTS

| | | | |
|---|---|---|---|
| JP | 63130637 | U | 8/1988 |
| JP | 7166879 | A | 6/1995 |
| JP | 9324644 | A | 12/1997 |
| JP | 2003278555 | A | 10/2003 |

* cited by examiner

VARIABLE NOZZLE TURBOCHARGERS

This application claims priority to Japanese patent application serial number 2013-104078, the contents of which are incorporated herein by reference.

BACKGROUND OF THE INVENTION

Field of the Invention

Embodiments of the present invention relate to variable nozzle turbochargers.

Description of the Related Art

Japanese Utility Model Publication No. 63-115532 and Japanese Utility Model Publication No. 63-92036 disclose a variable nozzle turbocharger equipped with a variable nozzle mechanism. The variable nozzle mechanism adjusts the degree of opening of variable nozzles having nozzle vanes through rotation of a unison ring. Through this adjustment, the flow velocity of exhaust gas to a turbine wheel is controlled. In Japanese Utility Model Publication No. 63-115532, plate springs respectively biasing the variable nozzles in an axial direction of the unison ring are fixed to the unison ring. As a result, it is possible to prevent rattling caused by a gap between a shaft portion of each variable nozzle and a housing supporting the shaft portion. In Japanese Utility Model Publication No. 63-92036, a tension coil spring biasing each variable nozzle in the opening direction is provided between a link member of each variable nozzle and the unison ring. As a result, it is possible to prevent rattling caused by a gap between each link member and the unison ring.

In a general variable nozzle mechanism, exhaust gas passing between the nozzle vanes of adjacent variable nozzles imparts a force so as to open the nozzle vanes. The force is transmitted to the unison ring and an actuator for driving the unison ring. Each member of the power transmission route within the actuator as well as each variable nozzle receives a force with which it is pressed in one direction. As a result, it is possible to suppress rattling caused by a gap or backlash or the like between the members connected together in the power transmission route.

As the nozzle vanes open, the amount of exhaust gas acting on the nozzle vanes decreases. In some cases, it is impossible to obtain the force required to press each member in one direction, e.g., the rotational force acting on the nozzle vanes so as to open the nozzle vanes with exhaust gas. Conventionally, to prevent this, the pivot ratio (or the rotary shaft position) of the variable nozzle, or the configuration of the nozzle vanes, has been changed. This, however, results in an increase in the pressure loss of the exhaust gas, thereby resulting in performance deterioration.

Each of the springs as disclosed in Japanese Utility Model Publication No. 63-115532 and Japanese Utility Model Publication No. 63-92036 is provided between each variable nozzle and the unison ring. The springs do not bias the unison ring so as to open the variable nozzles, but rather the springs bias the variable nozzle. Thus, the springs cannot cope with the above problem.

Therefore, there is a need in the art for a variable nozzle turbocharger capable of preventing rattling caused by a gap, backlash or the like between members that are coupled together in the power transmission route of a variable nozzle mechanism.

SUMMARY OF THE INVENTION

According to an aspect of the invention, a variable nozzle turbocharger has a variable nozzle mechanism for controlling a flow velocity of exhaust gas to a turbine wheel. The variable nozzle mechanism includes a plurality of variable nozzles, a unison ring and a biasing member. The variable nozzles each have a nozzle vane. The unison ring is configured to adjust a degree of opening of the variable nozzles through rotation of the unison ring. The biasing member biases the unison ring so as to open the variable nozzles.

As a result, it is possible to prevent rattling caused by a gap, backlash or the like between members connected together in a power transmission route. As compared with the related-art technique, this structure makes it possible to prevent an increase in pressure loss in the exhaust gas. Further, it prevents deterioration in performance without having to add any restrictions in terms of the design of the variable nozzles. According to the related-art technique, there is provided, for example, a structure for adjusting the pivot ratio of the variable nozzles, a structure for adjusting the positions of the pivots, or a structure for changing the configuration of the nozzle vanes.

The nozzle vanes receive a force from the exhaust gas flowing in the opening direction. In the operating condition in which the amount of exhaust gas is small, the force is reduced, and is compensated for by the spring member. Thus, the spring member supplies the requisite rotational force to the variable nozzles.

As an opening degree detection unit, an operation amount detection unit may be provided for detecting the opening degree of the variable nozzles. This is possible to detect the opening degree of the variable nozzles with high precision.

According to another aspect of the invention, the biasing member may be a spring member. The spring member may be provided between a housing member and the unison ring. The housing member may form an exhaust flow path for guiding exhaust gas to a turbine wheel.

According to another aspect of the invention, the biasing member may be a spring member. The spring member may be provided between a housing member and at least one of the variable nozzles. The housing member may form an exhaust flow path for guiding exhaust gas to a turbine wheel.

According to another aspect of the invention, the spring member may be arranged on an area opposite the driving member for driving the unison ring. In this manner, the spring member can effectively bias the unison ring.

DETAILED DESCRIPTION OF THE INVENTION

Each of the additional features and teachings disclosed above and below may be utilized separately or in conjunction with other features and teachings to provide improved variable nozzle turbochargers. Representative examples of the present invention, which utilize many of these additional features and teachings both separately and in conjunction with one another, will now be described in detail with reference to the attached drawings. This detailed description is merely intended to teach a person of ordinary skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful configurations of the present teachings.

Figure 1:
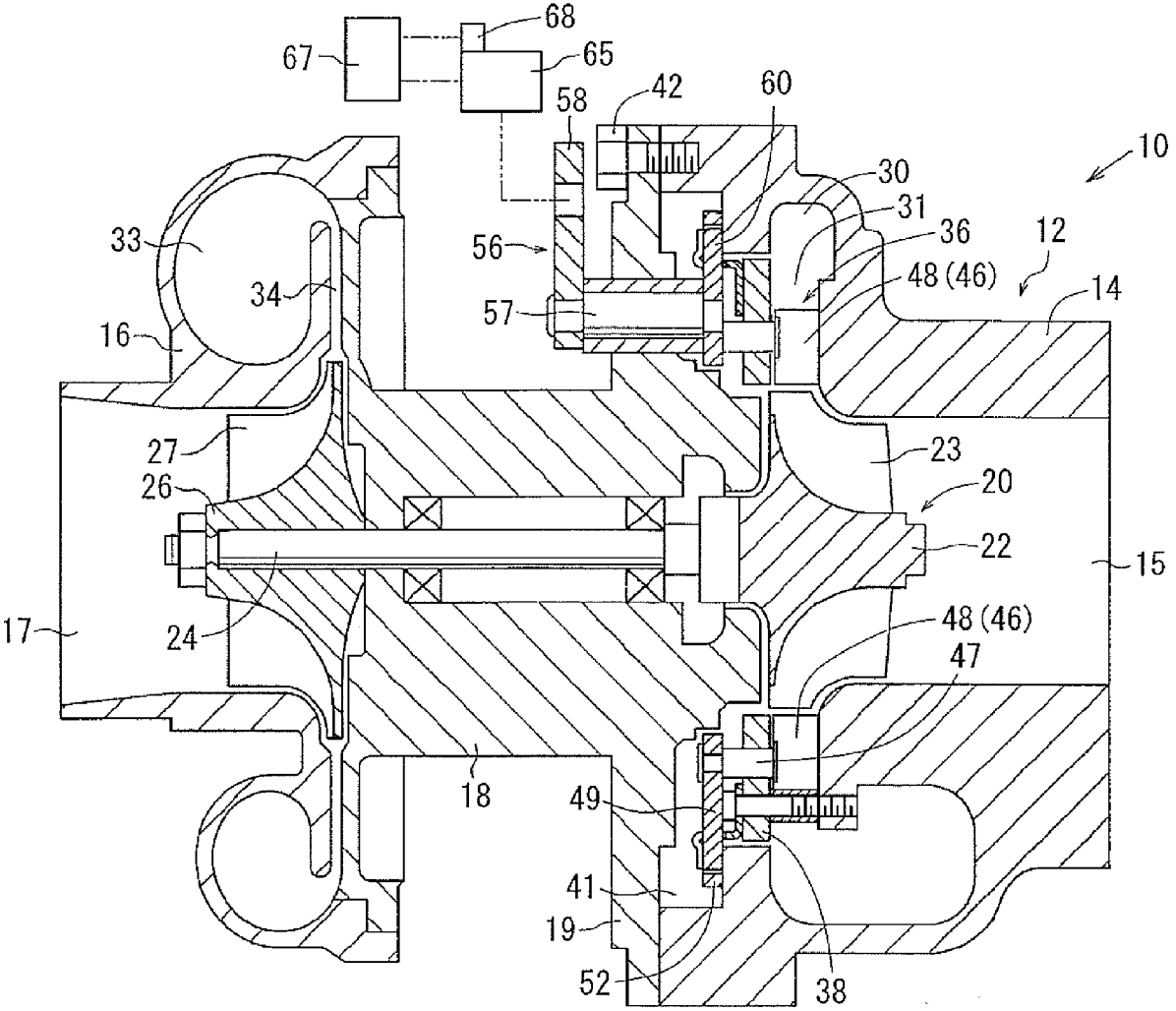
FIG. 1 is a cross-sectional view of a variable nozzle turbocharger.

As shown in FIG. 1, a variable nozzle turbocharger 10 has a rotor 20 rotatably accommodated in a rotor housing 12. The rotor housing 12 includes a turbine housing 14, a compressor housing 16 and a center housing 18. The center housing 18 connects the two housings 14 and 16 to each other.

The rotor 20 includes a turbine wheel 22, a rotor shaft 24 and a compressor wheel 26. The turbine wheel 22 has a plurality of blades 23 in the outer peripheral portion thereof. The turbine wheel 22 is arranged inside the turbine housing 14. The rotor shaft 24 is integrally mounted to the turbine wheel 22. The rotor shaft 24 is supported so as to be rotatable with respect to the center housing 18. The compressor wheel 26 is mounted to an end of the rotor shaft 24. The compressor wheel 26 has a plurality of blades 27 in the outer peripheral portion thereof. The compressor wheel 26 is arranged inside the compressor housing 16.

A spiral scroll path 30 is formed in the turbine housing 14. The scroll path 30 communicates with an annular swirl path 31 opposite to the blades 23 of the turbine wheel 22. The scroll path 30 communicates with an exhaust path for exhaust gas discharged from a combustion chamber of an internal combustion engine (not shown). The exhaust gas having flowed into the scroll path 30 is blown from the swirl path 31 toward the blades 23 of the turbine wheel 22. After rotating the turbine wheel 22, the exhaust gas is discharged from an exhaust outlet 15 of the turbine housing 14. The scroll path 30 and the swirl path 31 constitute an exhaust flow path for guiding exhaust gas to the turbine wheel 22.

A spiral compressor path 33 is formed in the compressor housing 16. The compressor path 33 communicates with an annular send-out path 34 opposite to the blades 27 of the compressor wheel 26. The compressor path 33 communicates with the combustion chamber of the internal combustion engine via an intake path (not shown). The compressor wheel 26 rotates integrally with the turbine wheel 22. The compressor wheel 26 compresses intake air introduced from an intake inlet 17 of the compressor housing 16 via the blades 27. The compressor wheel 26 sends out the intake air to the send-out path 34 using centrifugal action. The air discharged into the send-out path 34 is supercharged to the combustion chamber of the internal combustion engine via the compressor path 33.

The variable nozzle turbocharger 10 is provided with a variable nozzle mechanism 36. The variable nozzle mechanism 36 controls the flow velocity of the exhaust gas supplied to the turbine wheel 22 using the swirl path 31 of the turbine housing 14. An annular nozzle ring (housing member) 38 is provided in the turbine housing 14, specifically in an area of the swirl path 31. The area is next to the center housing 18. Thus, the nozzle ring 38 constitutes a side wall of the swirl path 31. The nozzle ring 38 is fixed to the turbine housing 14 by a plurality of, e.g., four connection bolts.

Figure 2:
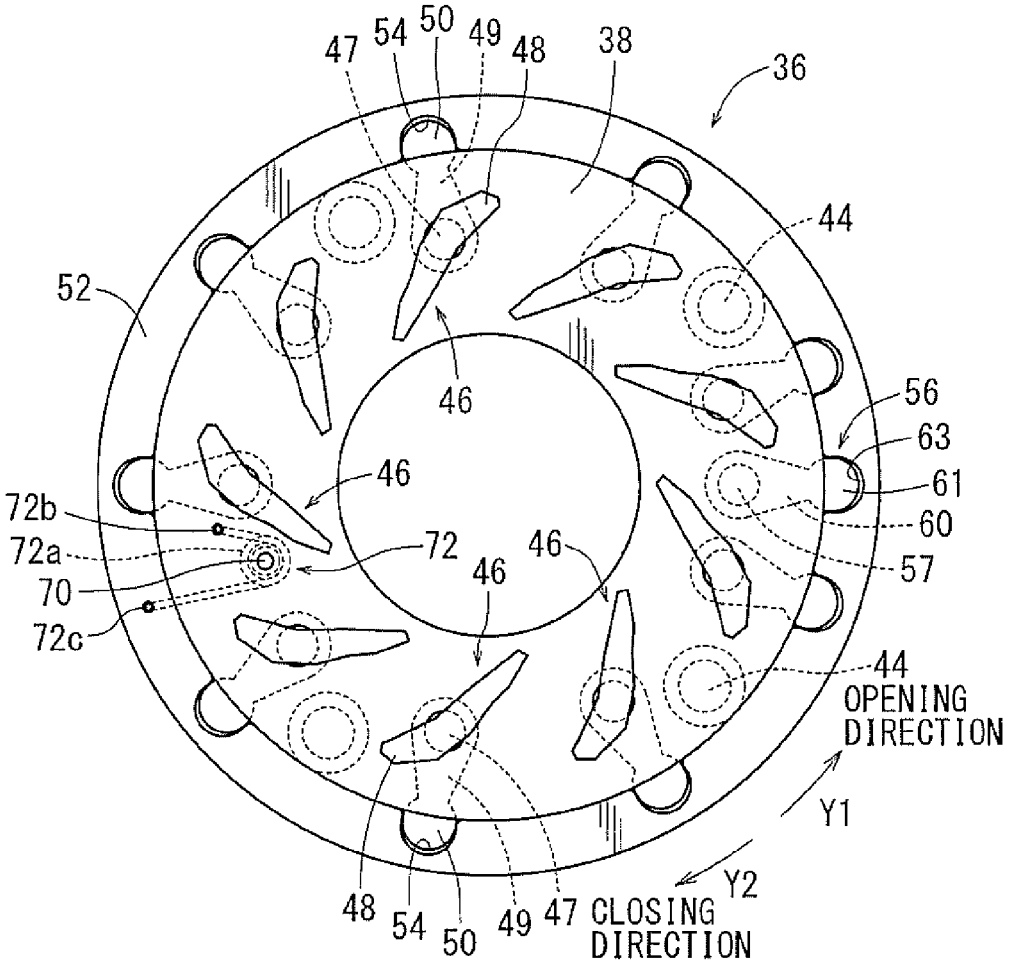
FIG. 2 is a schematic view of variable nozzles of a variable nozzle mechanism shown from a nozzle vane side.

An annular space 41 is formed in an area between the turbine housing 14 and the center housing 18. The nozzle ring 38 divides the annular space 41 and the swirl path 31. A flange-like side wall portion 19 is formed on the outer peripheral portion of the center housing 18. The side wall portion 19 is fixed to the turbine housing 14 by a bolt 42 to form the annular space 41. Retaining rollers 44 shown in FIG. 2 are arranged in the annular space 41. Each retaining roller 44 has a pin at its center. The pin rotatably retains the retaining roller 44 on the nozzle ring 38. The retaining rollers 44 rotatably retain a unison ring 52.

Figure 3:
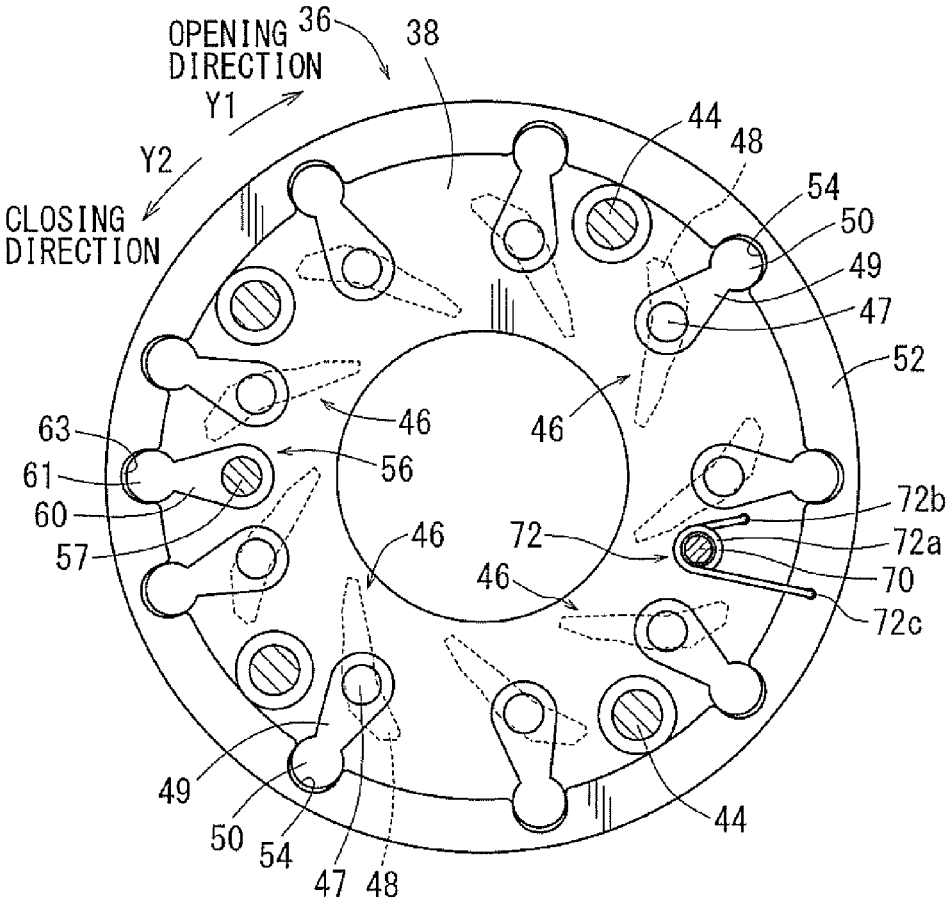
FIG. 3 is a schematic view of the variable nozzles shown from an arm side.

As shown in FIGS. 2 and 3, the variable nozzle mechanism 36 is provided with a plurality of, for example nine, variable nozzles 46. Each variable nozzle 46 has a pivot 47, a nozzle vane 48 and an arm 49. The pivot 47 is rotatably supported by the nozzle ring 38. The nozzle vane 48 is fixed to one end of the pivot 47. The arm 49 is fixed to the other end of the pivot 47. That is, each variable nozzle 46 is supported by the pivot 47 so as to be rotatable with respect to the nozzle ring 38. The plurality of variable nozzles 46 are arranged at equal circumferential intervals on the nozzle ring 38. A round fit-engagement portion 50 is formed at an end of each arm 49. The nozzle vanes 48 are rotatably arranged inside the swirl path 31, i.e., so as to be capable of opening and closing the swirl path 31. As shown in FIG. 1, the arms 49 are rotatably arranged within the annular space 41.

As shown in FIG. 1, the annular unison ring 52 is arranged within the annular space 41. The unison ring 52 is arranged concentrically with the nozzle ring 38. The unison ring 52 is situated at a position near the side wall portion 19 of the center housing 18 in the axial direction. In comparison to the unison ring 52, the nozzle ring 38 is positioned further from the side wall portion 19 of the center housing 18 in the axial direction. The retaining rollers 44 keep the unison ring 52 so that the unison ring 52 is rotatable around the axis in a space of the turbine housing 14. The space is formed between the wall portion 19 and the nozzle ring 38.

As shown in FIG. 3, arm fit-engagement grooves 54 are formed at equal circumferential intervals in the inner peripheral portion of the unison ring 52. The number of the arm fit-engagement grooves 54 is the same as the number of the variable nozzles 46. The arm fit-engagement grooves 54 are formed, for example, as U-shaped grooves. The arm fit-engagement grooves 54 open, for example, in the inner peripheral surface of the unison ring 52. The fit-engagement portion 50 of each arm 49 is rotatably engaged with each arm fit-engagement groove 54. The fit-engagement portions 50 are movable in the radial direction of the unison ring 52 along the arm fit-engagement grooves 54.

As shown in FIG. 1, a unison ring driving member 56 is provided on the side wall portion 19. The driving member 56 has a pivot 57, a driving lever 58 and a driving arm 60. The pivot 57 is rotatably supported by the side wall portion 19. The driving lever 58 is fixed to one end of the pivot 57. The driving arm 60 is fixed to the other end of the pivot 57. That is, the driving member 56 is rotatably supported on the side wall portion 19 by means of the pivot 57. The driving lever 58 is arranged so as to be rotatable outside the annular space 41. The driving arm 60 is rotatably accommodated in the annular space 41. As shown in FIG. 3, a round fit-engagement portion 61 is formed at an end portion of the driving arm 60.

As shown in FIG. 3, a driving arm fit-engagement groove 63 is formed in the inner peripheral portion of the unison ring 52. The driving arm fit-engagement groove 63 is situated between a pair of arm fit-engagement grooves 54 adjacent to each other. The driving arm fit-engagement groove 63 may be, for example, a U-shaped groove. The driving arm fit-engagement groove 63 opens in the inner peripheral surface of the unison ring 52. The fit-engagement portion 61 of the driving arm 60 is rotatably engaged with the driving arm fit-engagement groove 63. The fit-engagement portion 61 is movable in the radial direction of the unison ring 52 along the driving arm fit-engagement grooves 63. The driving arm 60 rotates around the pivot 57 together with the driving lever 58. As a result, the unison ring 52 rotates. The arms 49 of the variable nozzles 46 and the driving arm 60 can be formed in the same or substantially the same configuration. The arm fit-engagement grooves 54 of the unison ring 52 and the driving arm fit-engagement groove 63 can be formed in the same or substantially the same configuration.

As shown in FIG. 1, an output portion (not shown) of an actuator 65 is connected to the driving lever 58. The actuator 65 is, for example, an electric motor, an electromagnetic solenoid or an air cylinder. The actuator 65 can be installed in the rotor housing 12. The actuator 65 is controlled by a controller 67, and rotates the driving lever 58. The actuator 65 is provided with an operation amount detection unit (operation amount detection sensor) 68. The operation amount detection unit 68 may be, for example, an angle sensor for detecting the operation amount of the output portion of the actuator 65. The controller 67 calculates the rotational angle, i.e., the degree of opening of the variable nozzles 46 based on the output of the operation amount detection unit 68. Thus, the operation amount detection unit 68 is used as an opening degree detection unit for detecting the degree of opening of the variable nozzles 46.

The controller 67 operates the actuator 65 to rotate the driving member 56. This, in turn, rotates the unison ring 52. When, for example, the unison ring 52 rotates in the clockwise direction Y1 in FIG. 3, all of the variable nozzles 46 rotate in the opening direction about the axes of the pivots 47. When the unison ring 52 rotates in the counterclockwise direction Y2, all of the variable nozzles 46 rotate in the closing direction about the axes of the pivots 47. In this way, through the rotation of the unison ring 52, all the variable nozzles 46 rotate in synchronization with each other, thereby opening or closing the nozzle vanes 48. As a result, the opening degrees of the variable nozzles 46, or more specifically the opening degrees of the nozzle vanes 48, can be adjusted. The flow path cross-sectional areas between the adjacent nozzle vanes 48 are increased or decreased, whereby the flow velocity of the exhaust gas to the turbine wheel 22 is changed and adjusted.

As described above, the variable nozzle mechanism 36 has variable nozzles 46, a unison ring 52, a driving member 56 and an actuator 65. A plurality of members may be connected to each other in the power transmission route. For example, the arms 49 of the variable nozzles 46 and the unison ring 52 may be connected to each other. The unison ring 52 and the driving arm 60 of the driving member 56 may be connected to each other. The driving lever 58 of the driving member 56 and the output portion of the actuator 65 may be connected to each other. The driving member 56 constitutes one member of a driving mechanism.

Figure 4:
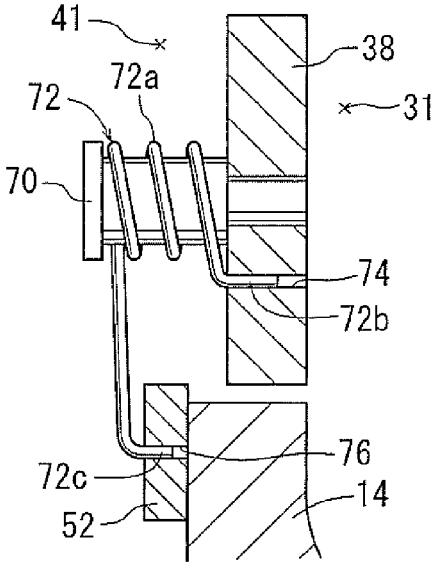
FIG. 4 is a cross-sectional view of a main portion of the variable nozzle mechanism.

As shown in FIGS. 3 and 4, a support pin 70 protrudes into the annular space 41 from the nozzle ring 38. A coil portion 72*a* of a spring member 72 is fit-engaged with the support pin 70. The spring member 72 may be, for example, a torsion coil spring. One terminal portion 72*b* of the spring member 72 may be locked to a spring lock portion 74 of the nozzle ring 38. The spring lock portion 74 may be for example a hole formed in the nozzle ring 38. The other terminal portion 72*c* of the spring member 72 is locked to a spring lock portion 76 of the unison ring 52. The spring lock portion 76 is for example a hole formed in the unison ring 52. The spring member 72 is provided between the nozzle ring 38 and the unison ring 52.

The spring member (biasing member) 72 biases the unison ring 52 with respect to the nozzle ring 38 in the direction Y1 in which the variable nozzles 46 are opened. The spring member 72 constantly biases the unison ring 52 so as to open the variable nozzles 46. The spring lock portions 74 and 76 may be holes or some other components. For example, the spring lock portions 74 and 76 may be recesses each having a bottom, grooves, protrusions or the like to which the terminal portions 72*b* and 72*c* of the spring member 72 are locked.

As shown in FIG. 3, the driving arm 60 is arranged in a first region (the left region) of the unison ring 52, and the spring member 72 is arranged in a second region (the right region). The second region is opposite the first region with respect to the perpendicular line passing through the central axis of the unison ring 52. The driving arm 60 is arranged between the arms 49 of a pair of adjacent variable nozzles 46 in the first region. The spring member 72 is arranged between a pair of adjacent arms 49 in the second region.

As described above, the spring member 72 is provided between the nozzle ring 38 and the unison ring 52. The spring member 72 constantly biases the unison ring 52 so as to open the variable nozzles 46.

As a result, it is possible to prevent rattling caused by a gap, backlash or the like between members connected together in the power transmission route. The connected members may be, for example, the arms 49 of the variable nozzles 46 and the unison ring 52. Alternatively, the connected members may be the unison ring 52 and the driving arm 60 of the driving member 56. Alternatively, the connected members may be the driving lever 58 of the driving member 56 and the output portion of the actuator 65. As compared with the related-art technique, this structure makes it possible to prevent an increase in pressure loss in the exhaust gas. Further, it prevents deterioration in performance without having to add any restrictions in terms of the design of the variable nozzles 46. According to the related-art technique, there is provided, for example, a structure for adjusting the pivot ratio of the variable nozzles 46, a structure for adjusting the positions of the pivots 47, or a structure for changing the configuration of the nozzle vanes 48.

The nozzle vanes 48 typically receive a force in the opening direction from the exhaust gas. In the operating condition in which the amount of exhaust gas is small, the force is reduced, and is compensated for by the spring member 72. Thus, the spring member 72 supplies the requisite rotational force to the variable nozzles 46.

The operation amount detection unit 68 may be the opening degree unit that detects the opening degree of the variable nozzles 46. In this way, it is possible to detect the opening degree of the variable nozzles 46 with high precision.

A power transmission mechanism such as a link mechanism or a gear mechanism is provided between the output portion of the actuator 65 and the driving arm 60 of the driving member 56. The spring member 72 constantly biases the unison ring 52 in the opening direction of the variable nozzles 46. Thus, it is possible for the spring member 72 to prevent rattling caused by a gap, backlash or the like between members connected to each other in the power transmission mechanism.

The spring member 72 is arranged substantially opposite to the driving mechanism (the driving arm 60, etc.) for driving the unison ring 52. In this way, the spring member 72 can effectively bias the unison ring 52. The spring member 72 may be arranged in any relationship with the unison ring 52. However, the spring member 72 is preferably arranged in a region opposite the driving mechanism. The unison ring 52 has a first region and a second region. The second region occupies half the unison ring 52, and the driving member 56 is provided at the center in the circumferential direction of the second region. The first region occupies the remaining half of the unison ring 52.

While the embodiments of invention have been described with reference to specific configurations, it will be apparent to those skilled in the art that many alternatives, modifications and variations may be made without departing from the scope of the present invention. Accordingly, embodiments of the present invention are intended to embrace all such alternatives, modifications and variations that may fall within the spirit and scope of the appended claims. For example, embodiments of the present invention should not be limited to the representative configurations, but may be modified, for example, as described below.

Figure 5:
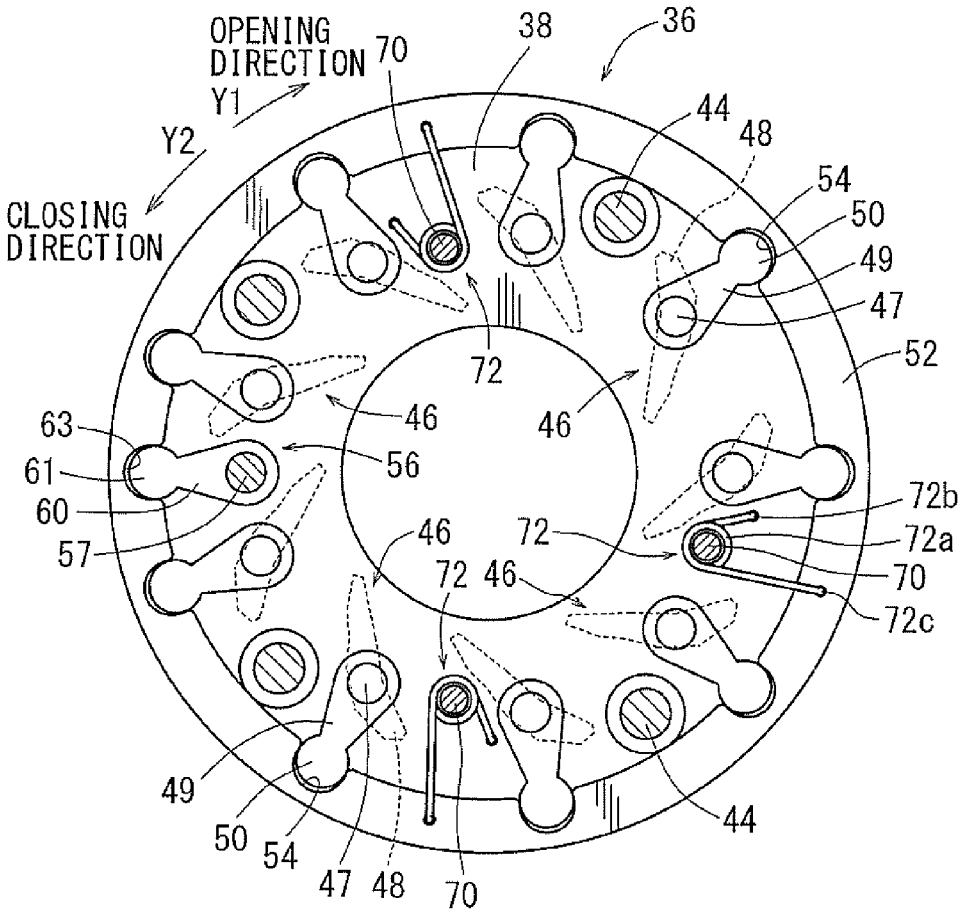
FIG. 5 is a schematic view of variable nozzles of another variable nozzle mechanism shown from an arm side.

The variable nozzle turbocharger may have a structure as shown in FIG. 5 rather than the structure of FIG. 3. The following description will focus on the differences from the structure of FIG. 3. In FIG. 5, there are provided three spring members 72. Like the spring member 72 of FIG. 3, a first spring member 72 is provided in a first region opposite the region where the driving arm 60 is provided. In the first region, there is provided the first arm 49 of the first variable nozzle 46. A second spring member 72 is provided in a first intermediate region (lower region) between the driving arm 60 and the first arm 49. A third spring member 72 is provided in a second intermediate region (upper region). Each of the second and third spring members 72 is provided between the arms 49 of the adjacent variable nozzles 46. The three spring members 72 are arranged at substantially equal circumferential intervals.

Figure 6:
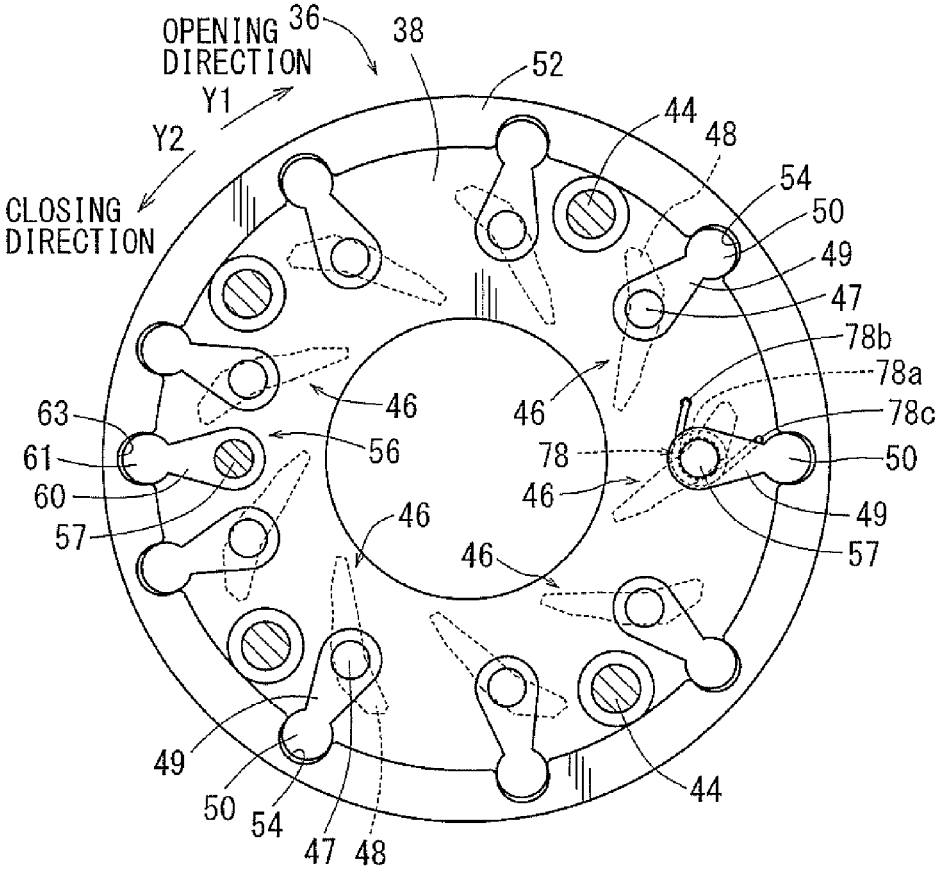
FIG. 6 is a schematic view of variable nozzles of another variable nozzle mechanism shown from an arm side.
Figure 7:
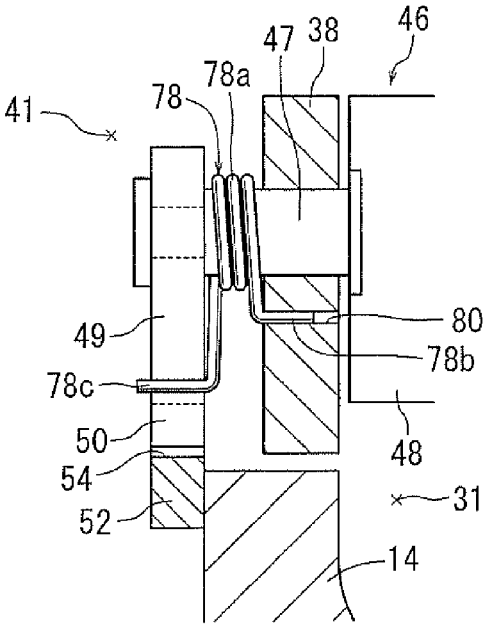
FIG. 7 is a cross-sectional view of a main portion of the variable nozzle mechanism of FIG. 6.

The variable nozzle turbocharger may have a structure as shown in FIGS. 6 and 7 rather than the structure of FIGS. 3 and 4. The structure shown in FIG. 6 has a spring member 78 instead of the spring member 72 shown in FIG. 3. The spring member (biasing unit) may be, for example, a torsion coil spring. The spring member 78 is provided between the variable nozzle 46 and the nozzle ring 38. The spring member 78 is provided in a first region opposite to a second region of the unison ring 52. In the second region, the driving mechanism (the driving arm 60) is provided.

As shown in FIG. 7, a coil portion 78*a* of the spring member 78 is fit-engaged with the pivot 47. The spring member 78 is arranged between the nozzle ring 38 and the arm 49 of the variable nozzle 46. One terminal portion 78*b* of the spring member 78 is locked to a spring lock portion 80. The spring lock portion 80 may be, for example, a hole formed in the nozzle ring 38. The other terminal portion 78*c* of the spring member 78 is engaged on the arm 49. The spring member 78 biases the nozzle ring 38 in the opening direction Y1 of the variable nozzle 46. As a result, the spring member 78 constantly biases the unison ring 52 in the opening direction of the variable nozzle 46. The spring lock portion 80 may be a hole, or some other component to which the terminal portion 78*b* of the spring member 78 is locked. For example, the spring lock portion 80 may be a recess with a bottom, a groove, a protrusion or the like formed in/on the nozzle ring 38.

Figure 8:
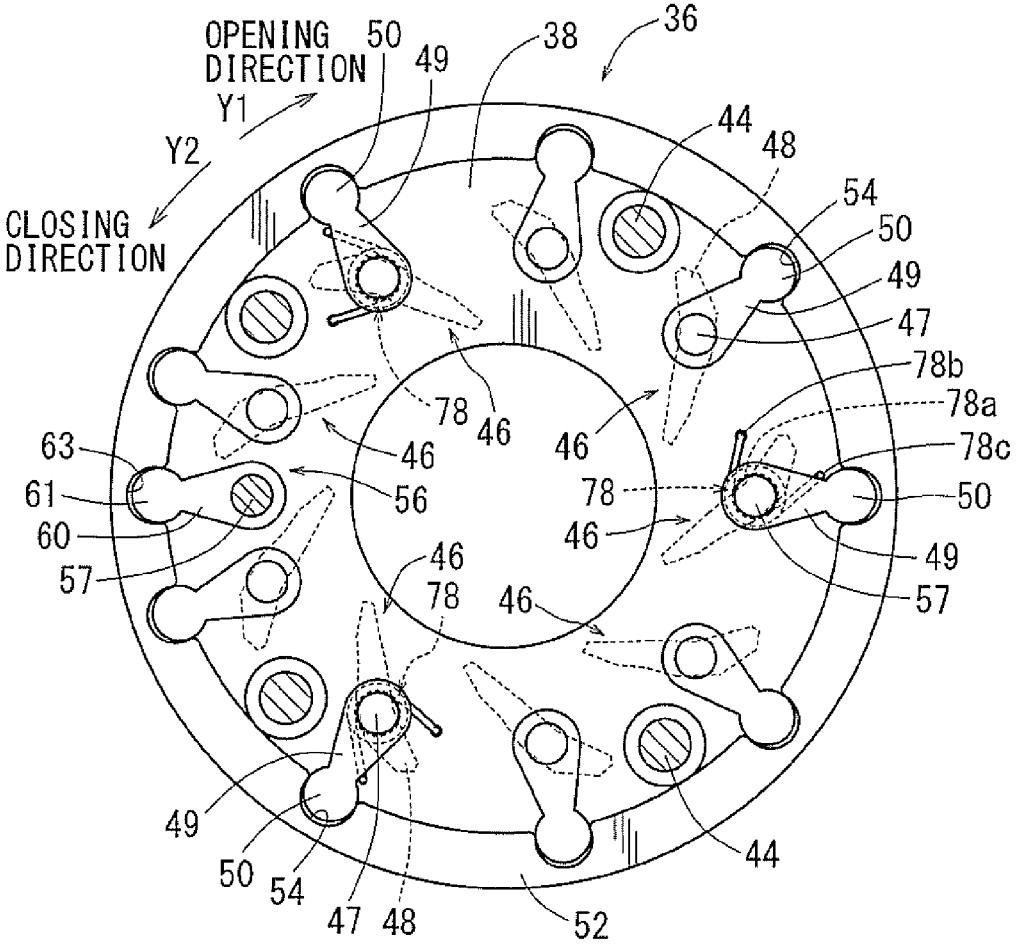
FIG. 8 is a schematic view of variable nozzles of another variable nozzle mechanism shown from an arm side.

The variable nozzle turbocharger may have a structure as shown in FIG. 8 rather than the structure of FIG. 6. The structure of FIG. 8 has the same spring member 78 as shown in FIG. 6. Additionally, the structure shown in FIG. 8 has second and third spring members 78. The first spring member 78 is arranged at the first variable nozzle 46 opposite the driving arm 60. The second and third spring members 78 are respectively arranged at the third variable nozzles 46 as counted in the circumferential direction (clockwise and counterclockwise) from the first variable nozzle 46. As a result, the three spring members 78 are arranged at substantially equal circumferential intervals.

The variable nozzle turbocharger has a biasing unit or a biasing member for biasing the unison ring 52 in the opening direction, e.g., the spring member 72, 78. The biasing unit or the biasing member may be a torsion coil spring, a tension coil spring, a compression coil spring, a plate spring or the like. The number of biasing units or biasing members, and the arrangement position and mounting structure thereof, are not restricted to those of the above-described embodiments.

This invention claims:

1. A variable nozzle turbocharger comprising:

a variable nozzle mechanism configured to control a flow velocity of exhaust gas to a turbine wheel, the variable nozzle mechanism including:

a plurality of variable nozzles each having a nozzle vane and a pivot, an annular nozzle ring configured to rotatably support each pivot of the plurality of variable nozzles, wherein the annular nozzle ring forms a side wall that directs a swirl path of an exhaust flow path for guiding exhaust gas to the turbine wheel;

a unison ring configured to adjust a degree of opening of the variable nozzles through rotation of the unison ring, a driving member configured to rotate the unison ring, and a spring member configured to bias the unison ring so as to open the variable nozzles, wherein the spring member includes a first end that is directly connected to the annular nozzle ring and a second end that is directly connected to the unison ring.

2. The variable nozzle turbocharger of claim 1, wherein the spring member is arranged on the unison ring such that a rotational center of the unison ring is arranged between the spring member and the driving member, and the driving member is connected to the unison ring.

3. The variable nozzle turbocharger of claim 1, wherein the spring member is not connected to the driving member.

4. The variable nozzle turbocharger of claim 1, wherein the spring member comprises coils that are layered in a direction transverse to a plane of rotation of the unison ring.

5. The variable nozzle turbocharger of claim 1, wherein the swirl path is an annular space and opens toward blades of the turbine wheel.

6. A variable nozzle turbocharger comprising:

a variable nozzle mechanism configured to control a flow velocity of exhaust gas to a turbine wheel the variable nozzle mechanism including:

a plurality of variable nozzles each having a nozzle vane and a pivot, a plurality of arms fixed to each of the variable nozzles, an annular nozzle ring configured to rotatable support each pivot of the plurality of variable nozzles, wherein the annular nozzle ring forms a side wall that directs a swirl path of an exhaust flow path for guiding exhaust gas to the turbine wheel;

a unison ring configured to adjust a degree of opening of the variable nozzles through rotation of the unison ring, wherein the plurality of arms is rotatable connected to the unison ring, a driving member configured to rotate the unison ring, and a spring member configured to bias the unison ring so as to open the variable nozzles, wherein:

the spring member includes a first end that is directly connected to the annular nozzle ring and a second end that is directly connected to one of the plurality of arms.

7. The variable nozzle turbocharger of claim 6, wherein the spring member is arranged on the unison ring such that a rotational center of the unison ring is arranged between the spring member and the driving member, and the driving member is connected to the unison ring.

8. The variable nozzle turbocharger of claim 6, wherein the swirl path is an annular space and opens toward blades of the turbine wheel.

* * * * *